US006601559B1

(12) United States Patent
Lazar

(10) Patent No.: US 6,601,559 B1
(45) Date of Patent: Aug. 5, 2003

(54) APPARATUS FOR INCREASING MECHANICAL EFFICIENCY IN PISTON DRIVEN MACHINES

(75) Inventor: John G. Lazar, 6781 Holts Store Rd., Julian, NC (US) 27283

(73) Assignees: John G. Lazar, Liberty, NC (US); Katherine A. Gaydos, Clemmons, NC (US)

( * ) Notice: Subject to any disclaimer, the term of this patent is extended or adjusted under 35 U.S.C. 154(b) by 0 days.

(21) Appl. No.: 09/935,226

(22) Filed: Aug. 21, 2001

(51) Int. Cl.[7] ..... F02B 75/32
(52) U.S. Cl. ..... 123/197.1
(58) Field of Search ..... 123/197.1, 197.4, 123/48 B

(56) References Cited

U.S. PATENT DOCUMENTS

| | | | | |
|---|---|---|---|---|
| 1,443,719 A | | 1/1923 | Schott | |
| 1,572,918 A | * | 2/1926 | Geddes | |
| 1,755,942 A | | 4/1930 | Woolson | |
| 1,901,263 A | | 3/1933 | Ruud | |
| 1,909,372 A | | 5/1933 | McCollum et al. | |
| 1,912,604 A | | 6/1933 | Valentine | |
| 2,314,789 A | | 3/1943 | Jacobsen | 123/197 |
| 2,589,958 A | | 3/1952 | Petit | 123/48 |
| 2,659,351 A | | 11/1953 | Chronic et al. | 123/65 |
| 2,822,791 A | | 2/1958 | Biermann | 123/48 |
| 2,865,350 A | | 12/1958 | Biermann | 123/48 |
| 2,873,611 A | | 2/1959 | Biermann | 74/40 |
| 2,909,163 A | | 10/1959 | Biermann | 123/48 |
| 2,909,164 A | | 10/1959 | Biermann | 123/48 |
| 2,989,954 A | | 6/1961 | Hulbert | 123/48 |
| 3,021,825 A | | 2/1962 | Garcia de la Para | 123/51 |
| 3,450,111 A | | 6/1969 | Cronstedt | 123/78 |
| 3,998,200 A | * | 12/1976 | Sudholt | 123/197.1 |
| 4,174,684 A | | 11/1979 | Roseby et al. | 123/48 B |
| 4,240,386 A | | 12/1980 | Crist | 123/48 B |
| 4,380,972 A | | 4/1983 | Parkins | 123/78 F |
| 4,517,931 A | | 5/1985 | Nelson | 123/48 B |
| 4,934,344 A | | 6/1990 | Perr | 13/58 A |
| 4,938,186 A | * | 7/1990 | Pal et al. | 123/197.1 |
| 5,228,415 A | * | 7/1993 | Williams et al. | 123/197.1 |
| 5,279,209 A | * | 1/1994 | Mayne | 123/197.1 |
| 5,537,957 A | * | 7/1996 | Gutkin | 123/197.1 |
| 5,595,146 A | | 1/1997 | Bollig et al. | 123/48 B |
| 5,983,845 A | * | 11/1999 | Yanagisawa | 123/197.1 |

* cited by examiner

*Primary Examiner*—Henry C. Yuen
*Assistant Examiner*—Jason Benton
(74) *Attorney, Agent, or Firm*—Womble Carlyle Sandridge & Rice, PLLC

(57) ABSTRACT

A device for increasing the mechanical efficiency of a piston-driven apparatus of the type having a housing containing at least one piston, at least one piston connecting rod, and a crankshaft having at least one crank and at least one crankpin, comprising a lever having one end pivotally connected to the housing to form a fulcrum point, the lever formed to pivotally connect to the piston connecting rod at a point, and a bearing block movably positioned on the lever, the bearing block being movable between first and second positions of the lever and operatively receiving a crankpin.

16 Claims, 7 Drawing Sheets

APPARATUS FOR INCREASING MECHANICAL EFFICIENCY IN PISTON DRIVEN MACHINES

FIELD OF THE INVENTION

The present invention relates generally to piston driven engines or machines and, more particularly, to an apparatus for increasing the mechanical efficiency of such engines or machines.

BACKGROUND OF THE INVENTION

Improving the efficiencies and capacities of internal combustion engines and motor-driven piston operating machines, such as compressors, has been the object of numerous design innovations. Many of these innovations have related to the materials of construction, forms of lubrication, and integrity of the piston and cylinder arrangement.

There are known in the art means for providing variable stroke and variable compression in internal combustion engines. There are also constructions that enable specific combinations of piston stroke and piston position to be varied within a single machine. There is also known a lever arrangement whereby the speed of the piston strokes and the relative piston position are varied for purposes of maximizing efficiency. In a conventional reciprocating internal combustion engine, a piston drives the crankshaft through a connecting rod during the power stroke and the kinetic energy of the crankshaft and flywheel drives the piston in the compression stroke. With a crank and connecting rod of fixed length where the rotation is around the crankshaft, however, mechanical inefficiency is inevitable.

While most of the prior art devices have sought to improve the performance of the internal combustion engine, none have sought to improve the mechanical efficiencies of conventional piston, connecting rod, and crankshaft configurations typical in motor-driven compressors or reciprocating internal combustion engines.

SUMMARY OF THE INVENTION

The present invention is directed to an apparatus and method for increasing the mechanical efficiency of an internal combustion engine or other piston-driven machine of the type having a block that houses at least one piston, a piston connecting rod, and a crankshaft having at least one crank and at least one crankpin. Thus, the present invention maximizes the force that is doing the work in the operation of the machine. A further object of the present invention is to provide an apparatus and method for similarly increasing the mechanical efficiency of a piston-operating device such as a compressor.

Accordingly, one aspect of the present invention includes a lever and sliding bearing block combination that varies the relative position of the crankpin and connecting rod with respect to a fulcrum point to maximize the force delivered during each stroke of the piston. A lever is pivotally connected to an inner wall or extension of the block housing so that its range of movement is in a vertical plane that is substantially perpendicular to the center of the crankshaft. The pivotal connection becomes the fulcrum point for the engine. The lever is so formed to pivotally connect to the piston connecting rod at a point on its upper surface between the fulcrum point and the free end of the lever. A bearing block is slidably engaged to the lever along flanges extending outwardly from the bottom of the lever and formed substantially along the entire length of the lever as the engine or compressor operates. Thus, the bearing block is free to slide between the fulcrum point and the free end of the lever. Below the lever, a circular aperture is formed through the bearing block for pivotal connection with the crankpin of the crank.

When the piston connecting rod and crankpin of the internal combustion engine are connected to the lever and bearing block respectively, and the engine is placed in operation, the apparatus moves as the crankshaft and crank rotate to provide a mechanical advantage for the particular stroke of the piston. Specifically, on the explosive power (downward) stroke of the piston, the bearing block slides toward the fulcrum point of the lever to a position on the lever between the fulcrum point of the lever and the connecting rod connection on the lever to create a mechanical advantage for the piston; i.e., the moment (distance times force) of the piston exceeds the moment of the crankpin. Conversely, on the compression (upward) stroke of the piston, the bearing block slides to position the crankpin so that the crankpin is further from the fulcrum point than the connecting rod connection point on the lever, thus creating a mechanical advantage for the crankpin on the crankshaft.

The lever and sliding bearing block arrangement described above may be utilized on any conventional piston-operated machine, including, for example, motor-driven compressors. The construction of the lever and the way in which the device works is similar to the internal combustion engine. Specifically, the compression stroke of a compressor, such as a motor-driven compressor, is similar to the compression stroke of the internal combustion engine. That is, on the compression stroke of the compressor, the block slides to position the crankpin outward from the connecting rod connection on the lever to create a mechanical advantage for the crankshaft.

These and other aspects of the present invention will become apparent to those skilled in the art after a reading of the following description of the preferred embodiment when considered with the drawings.

DESCRIPTION OF THE PREFERRED EMBODIMENTS

Figure 2:
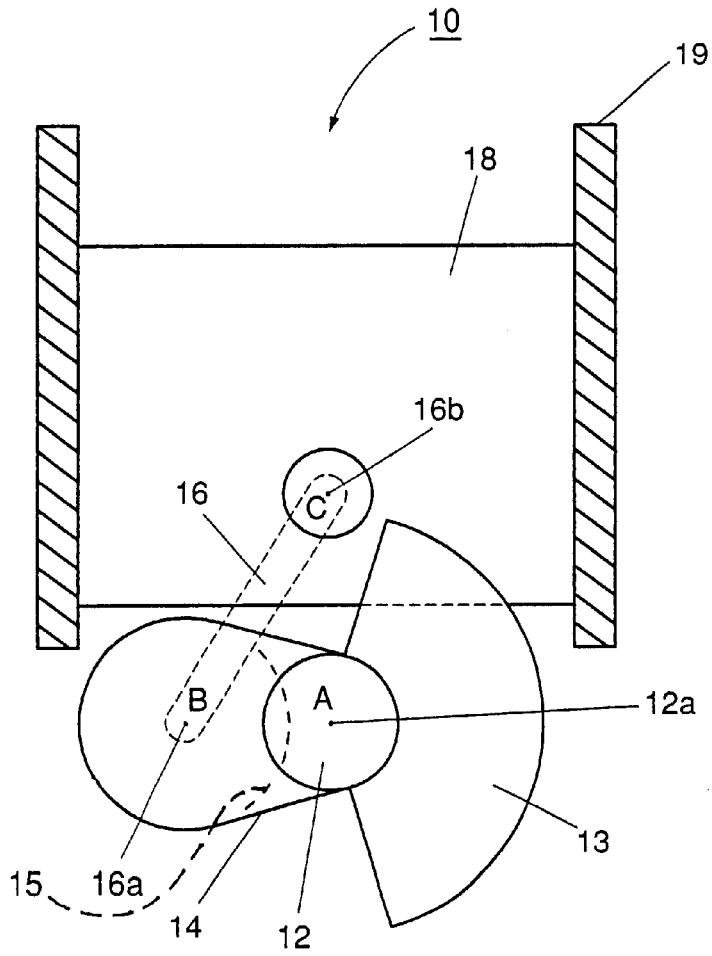
FIG. 2 PRIOR ART
FIG. 2 is a schematic illustration of the prior art with the relative positions of the crankshaft, crankpin, connecting rod, and piston at the mid-stroke position for the power stroke.
Figure 2A:
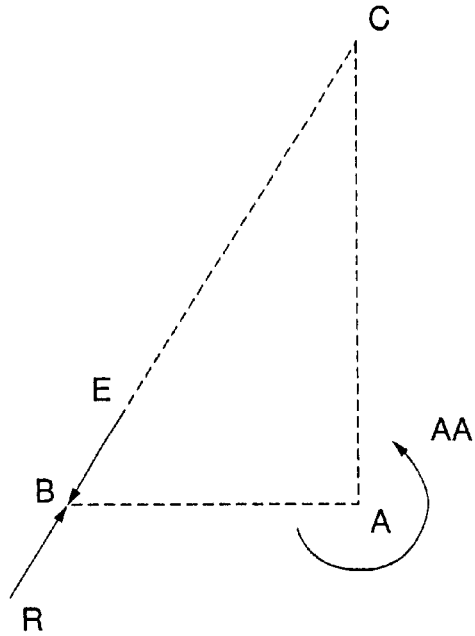
FIG. 2A is a schematic force diagram for the prior art illustration of FIG. 2.
Figure 3:
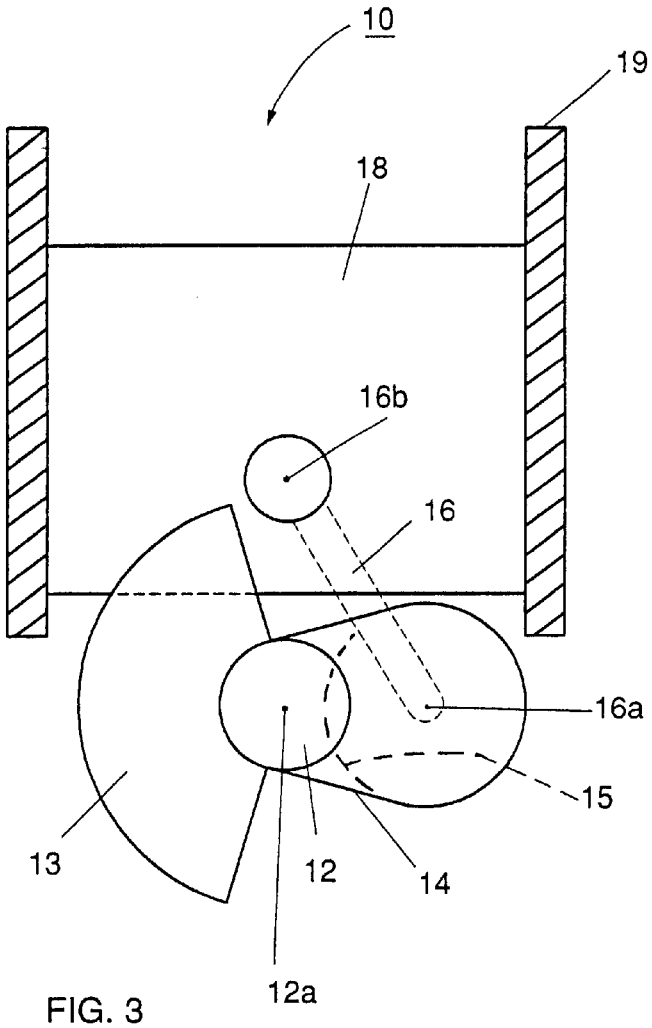
FIG. 3 PRIOR ART
FIG. 3 is a schematic illustration of the prior art with the relative positions of the crankshaft, crankpin, connecting rod, and piston at the mid-stroke position for the compression stroke.

Referring now to the drawings in general, it will be understood that the illustrations are for the purpose of describing a preferred embodiment of the invention and are not intended to limit the invention thereto. As best seen in FIGS. 2 and 3, the prior art reciprocating piston engines, or motor-driven reciprocating piston compressors (not shown), generally include a housing which contains a piston 18 moving reciprocally up and down within cyclinder 19. Reciprocating movement of the piston 18 causes a crank 14, which is connected to the piston by a connecting rod 16 to rotate the crankshaft 12. This is how reciprocal movement of the piston is converted to rotation of the crankshaft. Crankshaft 12 rotates about point 12*a*. Crank 14 is connected to one end of the connecting rod 16 by crankpin 15. A flywheel 13 is attached to the crankshaft 12 on the opposite side of crank 14. The other end of connecting rod 16 is pivotally connected to piston 18 by a pin connection 16*b*. FIG. 2 best illustrates piston 18 in a mid-stroke power stroke. FIG. 2A is a force diagram illustrative of the operation and dynamic forces inherent in this conventional construction. The illustrations described herein are for a 4-cycle internal combustion engine; however, as only the power and compression strokes are significant to the present invention, the intake and exhaust strokes will not be described since they are in the purview of those skilled in the art. Further, the descriptions herein are easily applied to 2-cycle engines and motor-driven compressors having reciprocating pistons.

In operation, the explosion cycle in an internal combustion engine drives the piston 18 downward in cylinder 19, causing crankshaft 12 to rotate counterclockwise, shown in FIG. 2A in the direction of Arrow AA. In the power stroke resulting from the explosion, piston 18 must exert enough force (shown as Arrow E) to overcome the resistance of crankshaft 12 (resistance is shown as Arrow R). Thus, in this conventional arrangement, the force E produced by piston 18 must be greater than the resistance R of the crankshaft 12 to rotate crankshaft 12 to produce continuous motive power. Practically, this means, for example, that to overcome a crankshaft resistance R of 10 pounds, piston 18 must exert a force greater than 10 pounds. Hence, in equilibrium, R would be equal to E.

Figure 3A:
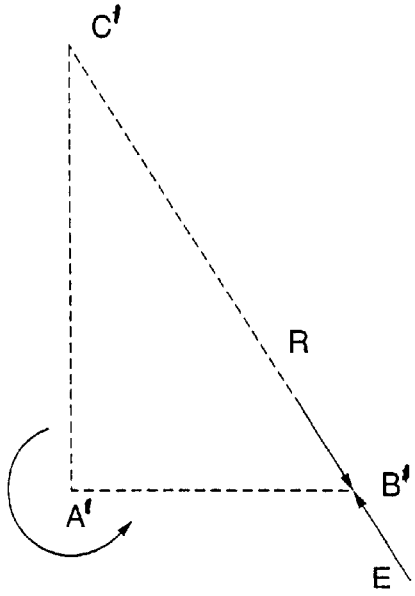
FIG. 3A is a schematic force diagram for the prior art illustration of FIG. 3.

In the compression stroke, illustrated schematically in FIGS. 3 and 3A, the kinetic energy of crankshaft 12 and flywheel 13 must be able to overcome the resistance of piston 18. That is, the residual kinetic energy (E') must be greater than the resistance (R') of piston 18 and cylinder 19 to produce a continuous motive power.

Thus, the conventional 4-cycle reciprocating piston engine is designed so that in either the power or the compression strokes, the piston and/or crankshaft forces must be greater than one another, respectively, depending on the stroke, to produce the continuous motive power necessary to drive the machine connected to crankshaft 12 (or in the case of a compressor, to compress air held in a pressurized vessel). As those skilled in the art of engineering statics and dynamics will readily understand, the force of effort E, E' must be equal to the resistance R, R' for the machine to be in equilibrium, and to ensure continuous motive force, E, E' must be greater than R, R' in any cycle. Thus, in the conventional machines of the prior art, there is no capacity to provide a mechanical advantage for either the crankshaft 12 or the piston 18 in any cycle.

Figure 1:
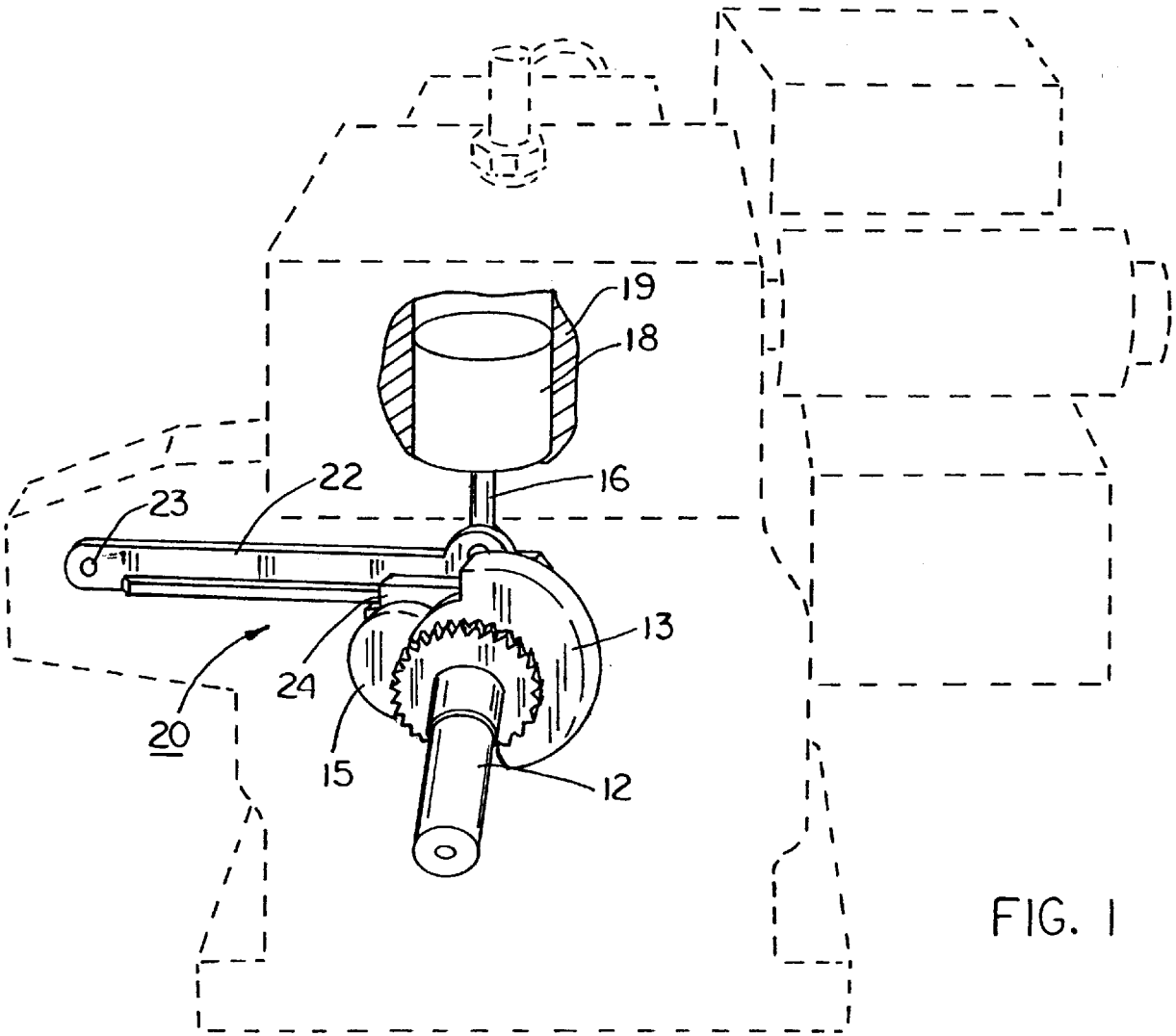
FIG. 1 is a cut-away environmental view of the present invention as installed in a Briggs & Stratton 3½ horsepower engine.
Figure 1A:
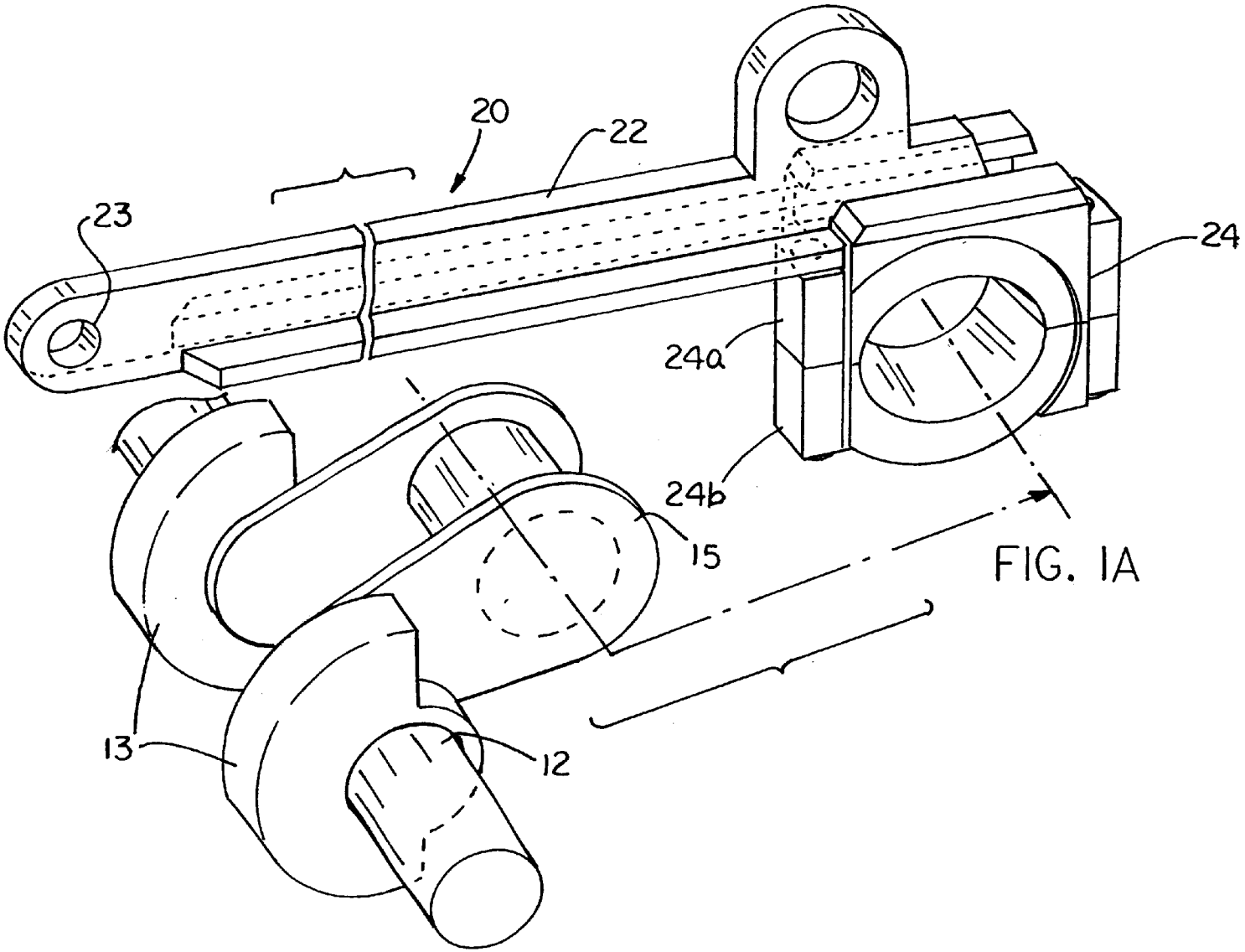
FIG. 1A is a perspective view of the apparatus of the present invention.
Figure 6:
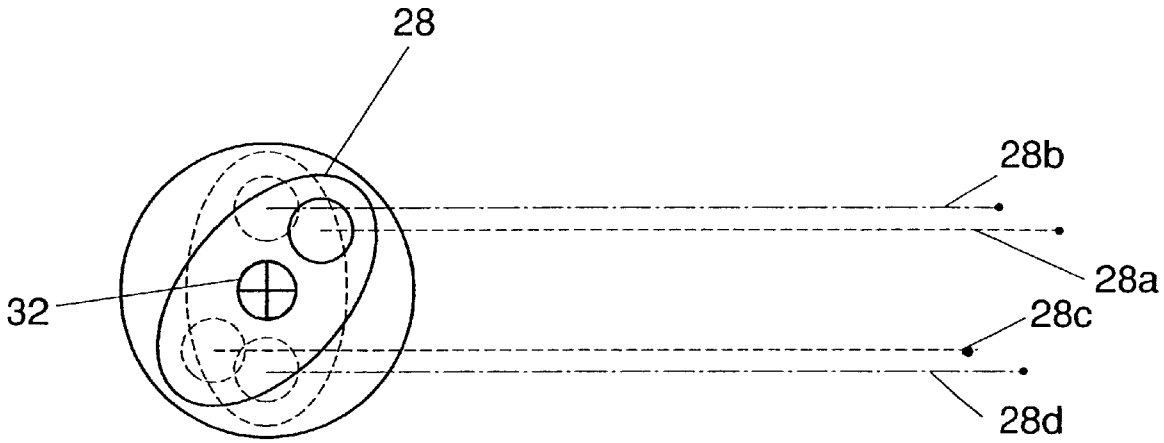
FIG. 6 is a schematic illustration of the fulcrum point adjustment mechanism.

Turning now to FIGS. 1, 1A, 4 and 4A, there is shown a schematic illustration of the preferred embodiment of the present invention. Piston 18, cylinder 19, and connecting rod 16 remain unaltered in shape and dimension. The present invention inserts a device that increases the mechanical efficiency of the system between the connecting rod and the crankpin of a conventional engine, demonstrated in FIG. 6 as a Briggs & Stratton 4-cycle internal combustion engine. Thus, the present invention may be incorporated into a engine from initial construction or may be installed separately later by one skilled in the art. FIG. 1 best shows a cut-away environmental view of the present invention as installed on a Briggs & Stratton 3.5 horsepower engine.

Figure 4A:
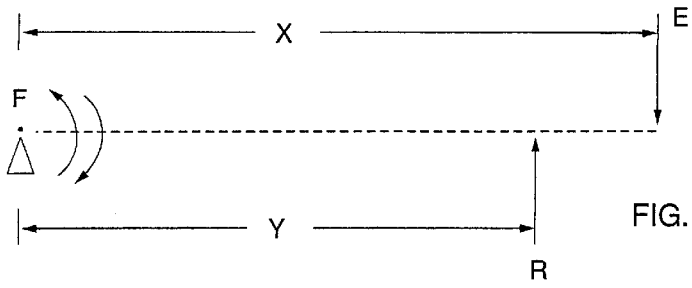
FIG. 4A is a schematic force diagram for the present invention of FIG. 4.
Figure 4B:
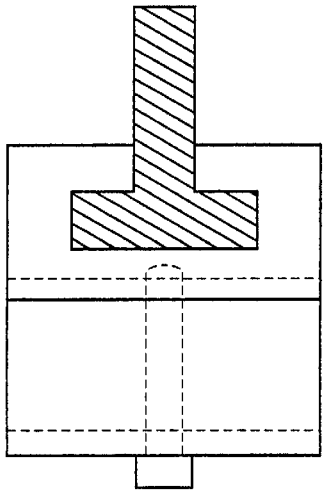
FIG. 4B is an end view of the lever and slidably engaged bearing block of the present invention.
Figure 4:
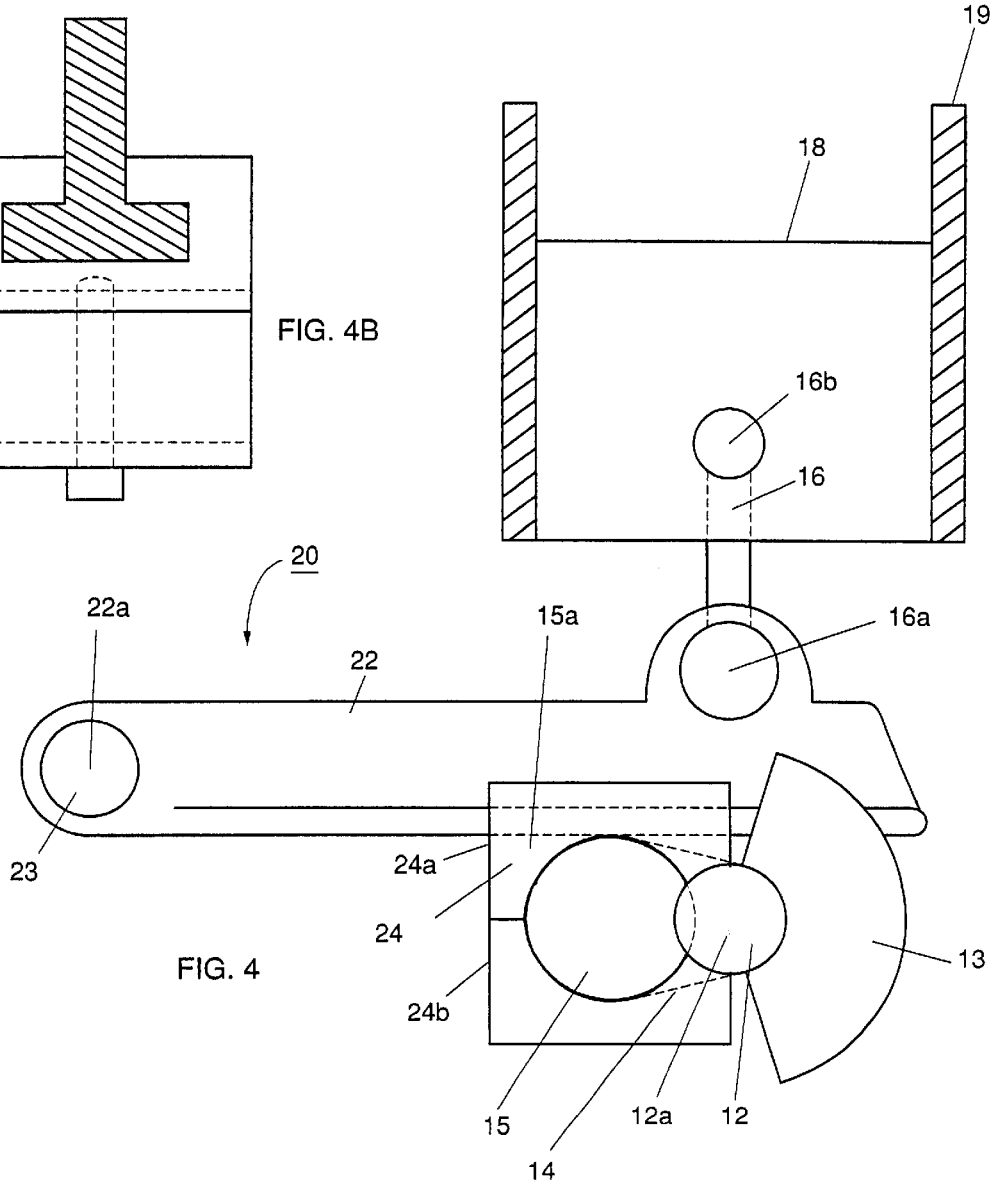
FIG. 4 is a schematic illustration of the present invention with the relative positions of the fulcrum point, connecting rod connection, and crankpin at the mid-stroke position for the power stroke.

To begin, and shown generally as 20, the apparatus of the present invention adds a lever 22 and a bearing block 24 to the conventional piston-operated machine. A perspective view of the lever 22 and block 24 is shown as FIG. 1A. Lever 22 is pivotally connected at a fulcrum point 22*a* by a pin 23. Fulcrum point 22*a* is formed either on a wall of the stock engine housing or as an extension of the housing, where spatial limitations so require. As used herein, "fulcrum" means a rigid point of support about which a lever pivots. "Lever" as used herein, refers to a rigid bar, pivoted about a fixed point (fulcrum), used to multiply force or motion. "Mechanical advantage" as used herein means the ratio of force produced by a machine such as a lever to the force applied to it. As best seen in FIG. 4, lever 22 in the present invention formed the pinned connection point 16a with connecting rod 16. Crankpin 15 is interconnected to the lever 22 via a bearing block 24 that is slidably movable along substantially the entire length of lever 22. FIG. 4B is an end view to demonstrate the inverted T geometry of lever 22 and its engagement with bearing block 24. It should be noted, and those skilled in the art will appreciate, lever 22 could also be I-shaped or be substantially rectangular with grooves formed along its length to engage bearing block 24.

Bearing block 24 is substantially rectangular or square in cross-section as these shapes are most easily fabricated from aluminum or other metallic stock material; however, other shapes would also provide suitable results. Bearing block 24 is formed of two generally symmetrical halves 24*a* and 24*b* so that bearing block 24 may be easily fitted around crankpin 15. The two halves are coupled together with machine screws 25*a* and 25*b*, or other suitable fasteners.

FIG. 4 is illustrative of the apparatus of the present invention at the mid-stroke position of the power stroke. In this position, the crankpin 15 and bearing block 24 are positioned between the connecting rod connection point 16a and fulcrum point 22*a*. Compare with FIG. 5 which shows the connecting rod connection point 16*b* between fulcrum point 22*a* and crankpin 15 within bearing block 24.

In operation, in an internal combustion engine in the explosion mode, piston 18 is driven downward against the crankpin, ultimately causing crankshaft 12 to rotate counterclockwise, providing motive power to the attached machine. Flywheel 13 provides a weighted balance to carry the crankshaft through the four cycles. That is, after being driven to its lowest position in cylinder 19, crankshaft 12 rotates to drive piston 18 upward in the compression cycle. There must be at least enough kinetic energy in crankshaft 12 and flyweel 13 to overcome the resistance of piston 18. As described hereinabove, in the conventional internal combustion engine, the effort (E, E') must be greater than the resistance (R, R') to continuously move the crankshaft.

Figure 5A:
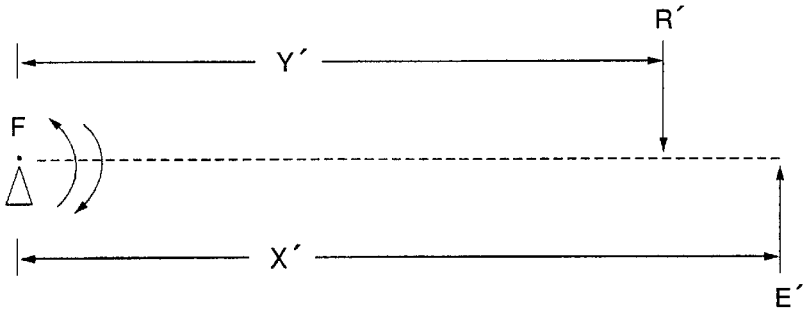
FIG. 5A is a schematic force diagram for the present invention of FIG. 5.
Figure 5:
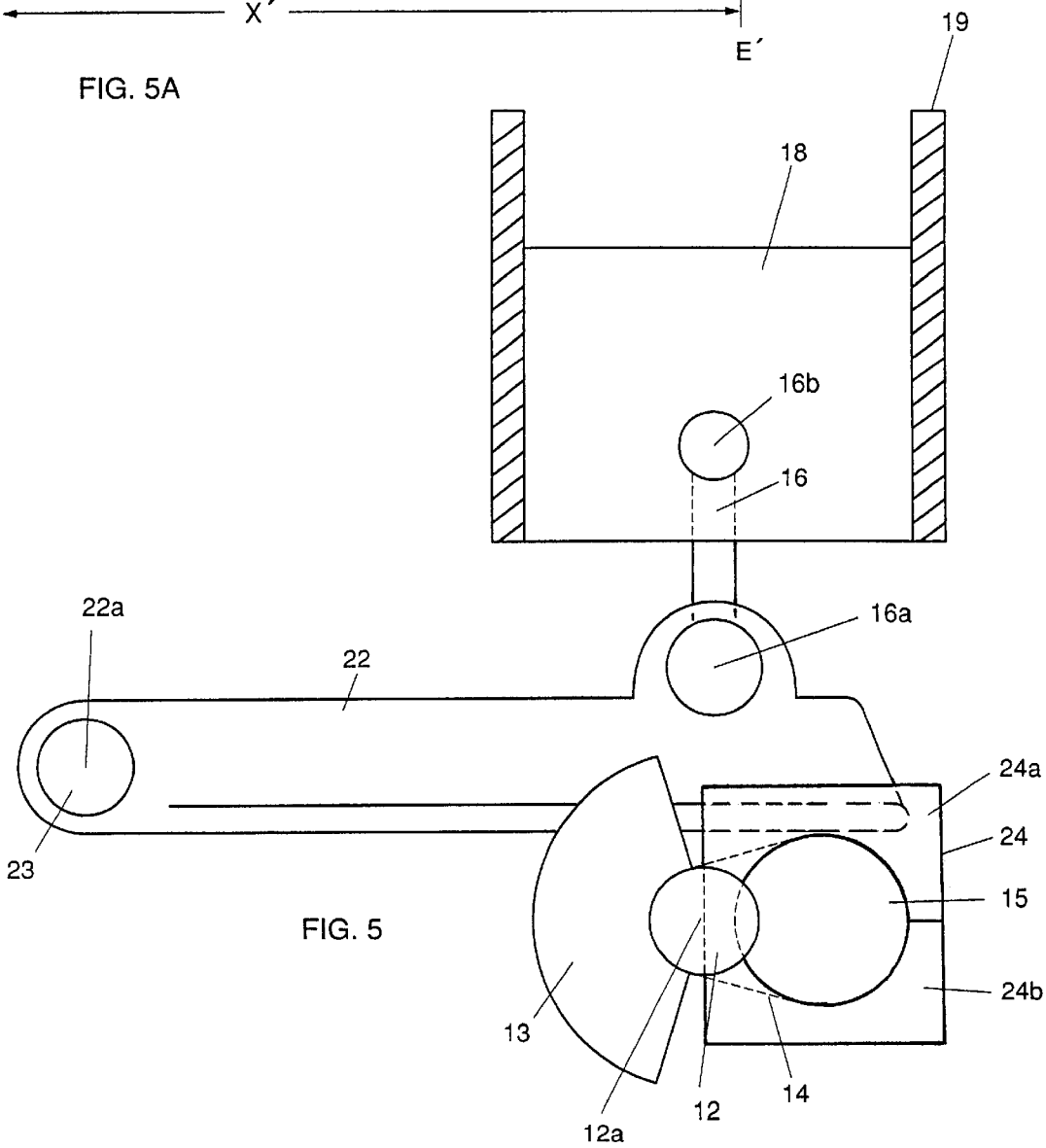
FIG. 5 is a schematic illustration of the present invention with the relative positions of the fulcrum point, connecting rod connection, and crankpin at the mid-stroke position for the compression stroke.

The present invention, on the other hand, causes the relative positions of the fulcrum point 22*a,* connecting rod connection point 16*a,* and crank 15 to produce a mechanical advantage for each cycle of the engine. Referring now to FIGS. 4A and 5A, this mechanical advantage will now be explained in detail.

With reference to FIG. 4A, at the mid-stroke position of the power stroke, the connecting rod connection point 16*a* is at a distance X from fulcrum point F. The force of effort E is thus X distance from fulcrum F. Thus, the torque created by effort E is the product of E times X. Similarly, the resistance R of the crankshaft is a distance Y from fulcrum point F. The effective torque created by R is equal to R times Y. Simply, the formula for mechanical advantage is as follows: (R×Y)=(E×X), or R/E=X/Y. In the power stroke shown in FIG. 4A, X is 4.125 inches and Y is 3.1 inches. This means that the maximum mechanical advantage is 4.125/3.1, or approximately 1.33. As those skilled in the art will appreciate, the maximum mechanical advantage for both power and compression strokes occurs at the mid-stroke position. At other than full stroke (piston as its maximum or minimum height in the cylinder), the mechanical advantage will be between 1.0 and the maximum value. At full stroke position, R and E are equal and thus there is no true mechanical advantage. As a numerical example, assume that crankshaft resistance R is equal to 10 pounds. In short, if R were 10 pounds, E would have to be only greater than 10/1.33, or approximately 7.52 pounds. This is almost 25 percent less force required than in the conventional piston-driven engine. This directly corresponds to approximately a maximum 25 percent energy, or fuel, savings during the power stroke with the apparatus of the present invention installed.

Referring now to FIG. 5A, there are shown the relative positions of the crankpin (E') and piston connecting rod connection point R' during the compression mid-stroke. During the compression stroke, the piston connecting rod connection point is a distance Y' from fulcrum point F and the crankpin is a distance X' from fulcrum point F. In the compression stroke shown in FIG. 5A, Y' is 4.125 inches and X' is 4.875 inches. This means that the mechanical advantage is 4.875/4.125, or approximately 1.18. Again, as a numerical example, assume that the piston resistance is 10 pounds. In that case, E would have to be only slightly greater than 10/1.18, or 8.47 pounds. This corresponds to approximately a maximum 15 percent savings in energy, or fuel, use.

Exemplary of the mechanical performance of the present invention, air pressure testing was conducted with a stock Briggs & Stratton 3½ horsepower engine. Air pressure was applied to the sparkplug aperture on both the power and compression strokes at three different pressures. A torque measuring device was mounted at the end of the crankshaft to measure the maximum torque delivered to the crankshaft. The results of that tests are shown in Tables 1 and 2 when performed on both the stock engine, and the stock engine modified with the apparatus of the present invention.

TABLE 1

| Stock Engine | |
|---|---|
| Air Pressure (PSI) | Torque (FT-LBS) |
| Power Stroke: 100 | 50 |
| Compression Stroke: 100 | 50 |
| Power Stroke: 90 | 45 |
| Compression Stroke: 90 | 45 |
| Power Stroke: 80 | 40 |
| Compression Stroke: 80 | 40 |

As expected, on the stock (unmodified) engine, the torque in both the power and compression strokes was the same, demonstrating that there was no mechanical advantage in the construction of the conventional stock engine.

TABLE 2

| Present Invention | |
|---|---|
| Air Pressure (PSI) | Torque (FT-LBS) |
| Power Stroke: 100 | 65 |
| Compression Stroke: 100 | 35 |
| Power Stroke: 90 | 60 |
| Compression Stroke: 90 | 30 |
| Power Stroke: 80 | 55 |
| Compression Stroke: 80 | 25 |

By contrast, and as exemplary, the torque delivered to the crankshaft with the present invention installed in the power stroke was 30 percent to 37 percent greater than the torque delivered with the stock engine. In the compression stroke, the torque delivered to the crankshaft by the present invention was between 30 and 37 percent less. As would be expected, the efficiencies demonstrated in testing vary from the calculated values due to calibration inaccuracies, tolerances, and operating conditions that vary from the simplified model. Nonetheless, the results clearly demonstrate the mechanical efficiency of the present invention when constructed as described above.

A further aspect of the present invention comprises lever 22, bearing block 24, and an adjustment mechanism 28 that replaces the pivotal pinned connection 23 of lever 22. The purpose of adjustment mechanism 28 is to permit piston stroke position and timing to be varied to satisfy specific desired operating conditions such as altered compression or adjusted revolutions per minute (RPM). The adjustment mechanism 28 is an eccentric disc that is rotably mounted about an adjusting member 32, such as a threaded bolt. As adjusting member 32 is manually or automatically rotated, the eccentric rotates to push lever 22 upward or downward as well as forward or rearward with respect to crankshaft 12. In the preferred embodiment, during the power stroke the crankpin position may be varied from between about 3 inches to 3.3 inches from fulcrum point F. During the compression stroke, the crankpin position may be varied from between about 4.75 inches to 5.1 inches from fulcrum point F. These dimensions are only exemplary of the present invention as installed on a Briggs & Stratton 3.5 horsepower engine, and will vary based upon the size and model of engine or compressor so modified by the present invention.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. An apparatus for increasing the mechanical efficiency of a piston-driven machine of the type having a housing containing at least one cylinder and piston, at least one piston connecting rod connected to the piston at one end, and a crankshaft having at least one crank and at least one crankpin, the apparatus being interconnected between the connecting rod and the crankpin and comprising:

(a) a lever having a first end and a second end, the first end of the lever being pivotally connected to the housing adjacent to the cylinder to form a fulcrum point, said lever formed to pivotally connect to each piston connecting rod at a point between the first and second ends of the lever;

(b) a bearing block movably positioned on the lever, the bearing block being moveable between first and second positions of the lever and operatively receiving the at least one crankpin therein;

(c) wherein when the piston connecting rod and the crankpin of the machine are connected to the lever and the block and the piston is made to reciprocate:

(i) during a first stroke of the piston, the bearing block is moved to a point where the crankpin is positioned between the fulcrum point of the lever and the connecting rod connection on the lever to deliver mechanical advantage to the crankpin; and (ii) on a second stroke of the piston, the bearing block is moved to a point where the connecting rod connection on the lever is between the fulcrum point of the lever and the crankpin to deliver mechanical advantage to the piston.

2. The apparatus of claim 1 wherein said piston-driven machine is an internal combustion engine.

3. The apparatus of claim 1 wherein said piston-driven machine is a motor-driven compressor.

4. The apparatus of claim 1 wherein the lever is substantially linear.

5. The apparatus of claim 1, further including an adjustment mechanism for varying the lateral and vertical position of the lever with respect to the fulcrum point of the lever.

6. The apparatus of claim 5 wherein said adjustment mechanism includes an eccentric member for varying the horizontal and vertical position of the lever.

7. A piston-driven machine of the type having a housing containing at least one piston, a piston connecting rod connected to the piston at one end, and a crankshaft having at least one crank and at least one crankpin, said engine further including:

(a) a lever having a first end and a second end, the first end of the lever being pivotally connected to the housing or an extension thereof to form a fulcrum point, the lever so formed to pivotally connect to the piston connecting rod at a point between the first and second ends of the lever;

(b) a bearing block movably positioned on the lever, the block being moveable between first and second positions of the lever and operatively receiving the at least one crankpin therein; and (c) wherein when the piston connecting rod and the crankpin are connected to said lever and the bearing block and the piston is made to reciprocate, the bearing block is moved between the first and second positions of the lever to deliver mechanical advantage to the piston and the crankshaft respectively.

8. The machine of claim 7 wherein the piston-driven machine is an internal combustion engine.

9. The machine of claim 7 wherein said piston-driven machine is a motor-driven compressor.

10. The machine of claim 7 wherein the lever is substantially linear.

11. The machine of claim 7, further including an adjustment mechanism for varying the lateral and vertical position of the lever with respect to the fulcrum point of the lever.

12. The apparatus of claim 11 wherein said adjustment mechanism includes an eccentric member for varying the horizontal and vertical position of the lever.

13. A method for increasing the mechanical efficiency of a piston-driven machine of the type having a housing containing at least one piston, at least one piston connecting rod connected to the piston at one end, and at least one crankpin, comprising:

(a) varying the position of the crankpin relative to the connecting rod by use of a lever to deliver mechanical advantage to the crankpin during a first stroke of the piston; and (b) varying the position of the crankpin relative to the connecting rod by use of the lever to deliver mechanical advantage to the piston during a second stroke of the piston.

14. The method of claim 13 wherein the position of the crankpin is varied by:

(a) connecting a lever to said housing at a fulcrum point formed in said housing or an extension thereof;

(b) pivotally connecting the connecting rod to the lever at a fixed point along the length of the lever;

(c) movably positioning a bearing block on the lever; and (d) pivotally connecting the bearing block to the crankpin of the piston-driven machine.

15. The method of claim 14 wherein the mechanical advantage during the first stroke is obtained by positioning the connecting rod at a point further from the fulcrum point than the bearing block.

16. The method of claim 14 wherein the mechanical advantage during the second stroke is obtained by positioning the bearing block at a point further from the fulcrum point than the connecting rod.

* * * * *